United States Patent [19]

Mantell

[11] Patent Number: 4,934,902

[45] Date of Patent: Jun. 19, 1990

[54] FAILURE SENSING DEVICE FOR A DIAPHRAGM PUMP

[76] Inventor: Myron Mantell, 4 Rudden La., Morris Plains, N.J. 07950

[21] Appl. No.: 269,261

[22] Filed: Nov. 9, 1988

Related U.S. Application Data

[60] Division of Ser. No. 153,192, Feb. 8, 1988, Pat. No. 4,787,825, which is a division of Ser. No. 828,411, Feb. 11, 1986, Pat. No. 4,740,139, which is a continuation-in-part of Ser. No. 655,369, Sep. 27, 1984, Pat. No. 4,569,634.

[51] Int. Cl.[5] ..... F04B 21/00; F04B 43/06

[52] U.S. Cl. ..... 417/63; 417/395; 92/5 R; 340/605

[58] Field of Search ..... 417/63, 9, 395; 92/5 R, 92/97; 116/206; 340/605

[56] References Cited

U.S. PATENT DOCUMENTS

| | | | |
|---|---|---|---|
| 2,323,950 | 7/1943 | Wade | 417/63 |
| 2,662,478 | 12/1953 | Surre | 417/63 |
| 3,131,638 | 5/1964 | Wilson et al. | 417/395 X |
| 3,605,566 | 9/1971 | Vetter | 417/63 |
| 3,661,060 | 5/1972 | Bowen | 417/63 X |
| 4,569,634 | 2/1986 | Mantell | 417/63 |
| 4,740,139 | 4/1988 | Mantell | 417/63 |
| 4,787,825 | 11/1988 | Mantell | 417/63 |
| 4,838,763 | 6/1989 | Krämer et al. | 417/63 |
| 4,854,823 | 7/1989 | Hatting et al. | 417/63 |

FOREIGN PATENT DOCUMENTS

| | | | |
|---|---|---|---|
| 1453454 | 2/1969 | Fed. Rep. of Germany | 417/395 |
| 2620228 | 11/1977 | Fed. Rep. of Germany | 417/383 |
| 3334638 | 3/1984 | Fed. Rep. of Germany | 417/63 |
| 195087 | 11/1983 | Japan | 417/63 |

*Primary Examiner*—Leonard E. Smith
*Assistant Examiner*—Eugene L. Szczecina, Jr.
*Attorney, Agent, or Firm*—Sheldon H. Parker

[57] ABSTRACT

In accordance with the present invention, a diaphragm pump having a housing, a first chamber within said housing, a second chamber within said housing and a pair of diaphragm elements mounted in said housing between said first chamber and said second chamber, is provided with a failure sensing system for the diaphragm. The failure sensing system including a failure sensing device which is between the two parts of the diaphragm and an indicator circuit which includes the conductive liquid which is being pumped and an alarm. The two parts of the diaphragm element are clamped together proximate their peripheral edge such that a circumferentila fluid tight compression seal region is provided. The sensing device includes an electrically conductive lead which extends from the exterior of the housing, through the circumferential fluid tight seal region into the region peripherally inward of the seal region. The electrically conductive material is, advantageously, an electrically conductive graphite and in the form of a filament, fibers or strands. Thus, when a failure of the diaphragm occurs, conductive liquid comes into electrical contact with said lead and completes a circuit to sound an alarm thereby indicating the failure of said diaphragm.

20 Claims, 4 Drawing Sheets

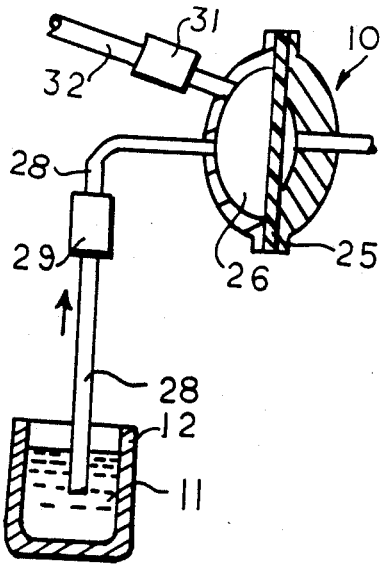
FIG 1
PRIOR ART
FIG 2
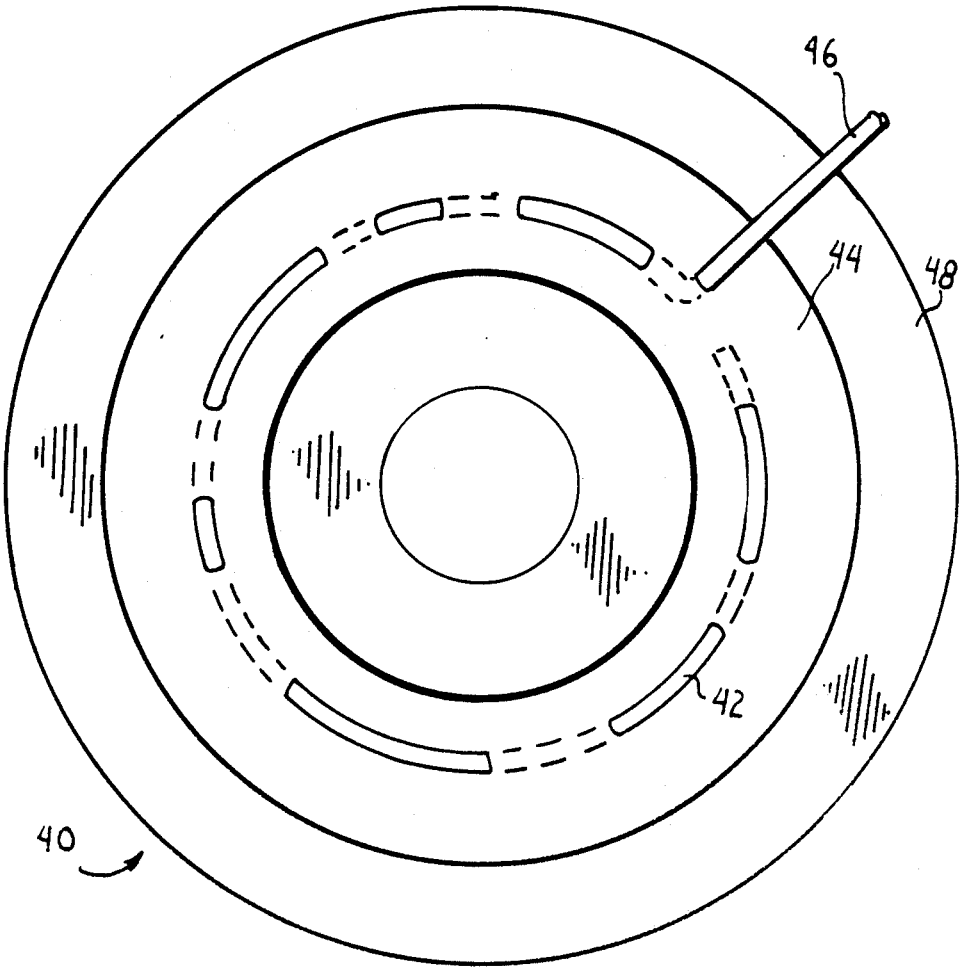

FIG 8
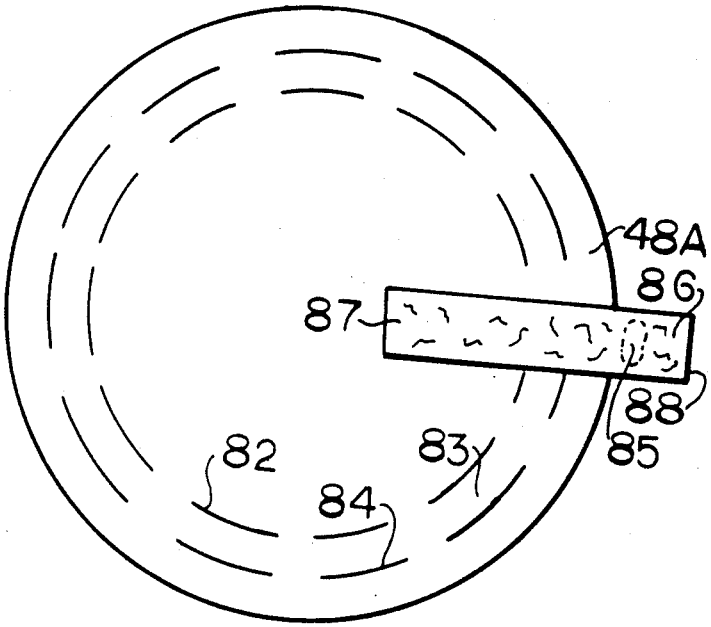
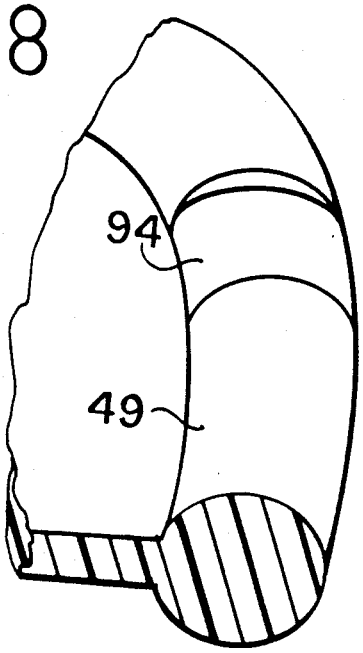
FIG 6
FIG 9
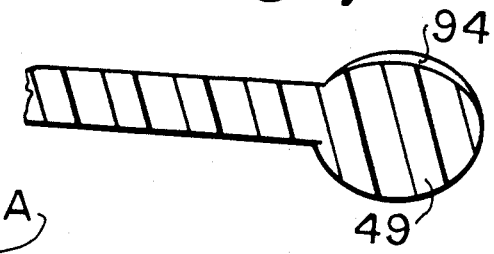
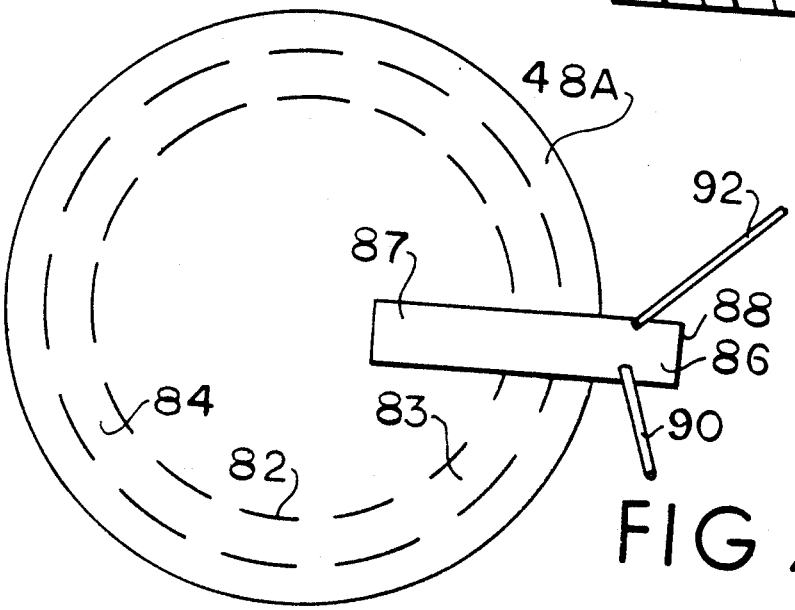
FIG 7

FAILURE SENSING DEVICE FOR A DIAPHRAGM PUMP

CROSS REFERENCE TO RELATED APPLICATION

This is a divisional of co-pending application Ser. No. 153,192 filed on Feb. 8, 1988, now U.S. Pat. No. 4,787,825, which is divisional of co-pending application Ser. No. 828,411 filed Feb. 11, 1986, now U.S. Pat. No. 4,740,139 which is a continuation-in-part of co-pending application Ser. No. 655,369, filed Sept. 27, 1984, now U.S. Pat. No. 4,569,634.

BACKGROUND OF THE INVENTION

1. Technical Field

This application relates to an improved failure sensing device for use in diaphragm pumps.

2. DESCRIPTION OF THE PRIOR ART

Diaphragm pumps are widely used in the chemical, petrochemical, process and other industries, as noted for example, in U.S. Pat. No. 3,285,182, which refers to such specific uses as in reagent feeding in reactor systems, replenishers and activators in photochemical and electro-chemical systems.

U.S. Pat. No. 3,666,379, teaches that when handling corrosive fluids, it is desirable to use a diaphragm disk which should be made of a chemically inert polymer such as polytetrafluroethylene (PTFE). The patent indicates that the previous inability to use PTFE can be overcome through the use of the disk referred to in the patent. Unfortunately, attack of the diaphragm by corrosives, fatigue or solvents still leads to the failure of the diaphragm.

The attempts to improve the physical design and chemistry of the material of construction of the diaphragm have lead to improvements. However, diaphragms still have a finite life span.

Devices in accordance with the prior art in the past have been known to exhibit certain shortcomings and problems. As noted in U.S. Pat. No. 3,816,034, mechanically or positively actuated diaphragm pumps suffer from: the disadvantage that the diaphragm, due to its positive mechanical connection to a reciprocating drive, is subject to a combination of high shear, bending and tension stresses in the operation of the pumping cycle. Such stresses then lead to shutdowns and replacement of the diaphragm when destruction thereof is imminent or has occurred.

The failure of the diaphragm is normally proceeded by the development of minute cracks, tears or hair line fissures which expand until there is a pathway completely through the diaphragm.

The problem associated with the replacement of a diaphragm after failure is that failure takes place when the diaphragm stress induced cracks open to the point where there is a hole completely through the diaphragm and consequently, there is a passage for the flow of liquid between the two pump chambers which are normally separated by the diaphragm. Thus, failure can result in heavy losses due to contamination of material streams, exposure of hardware to corrosives, and excessive down time. The fundamental problem is that it is essentially impossible to predict with accuracy the point in time at which the diaphragm will fail. Predictions are thus made on a statistical average basis, which means that some diaphragm will fail before the time period for periodic replacement and some diaphragm will be replaced prematurely, that is, before the major time period of their life span has been expended.

SUMMARY OF THE INVENTION

It has now been found that the problems encountered with the prior art systems can be overcome through the use of a mechanism which is capable of signaling the imminent failure of the diaphragm due to the attack by a corrosive or a solvent or mechanical fatigue.

In accordance with the present invention, a diaphragm pump having a housing, a first chamber within said housing, a second chamber within said housing and a pair of diaphragm elements mounted in said housing between said first chamber and said second chamber, is provided with a failure sensing system for the diaphragm. The failure sensing system including a failure sensing means which is between the two parts of the diaphragm and an indicator circuit which includes the conductive liquid which is being pumped and alarm means. The two parts of the diaphragm element are clamped together proximate their peripheral edge such that a circumferential fluid tight compression seal region is provided. The sensing means includes an electrically conductive lead means which extends from the exterior of the housing, through the circumferential fluid tight seal region into the region peripherally inward of the seal region. The electrically conductive material is, advantageously, an electrically conductive graphite and in the form of a filament, fibers or strand (which terms are employed interchangeable within the context of the invention). Thus, when a failure of the diaphragm occurs, conductive liquid comes into electrical contact with said lead means and completes a circuit to sound an alarm thereby indicating the failure of said diaphragm.

The system of the instant invention provides among its advantages, extreme ease of manufacture, reliability and low cost, through the use of an unusually low number of simple parts.

BRIEF DESCRIPTION OF THE DRAWINGS

The objects and advantages of the invention will become more apparent and more readily understood when the following detailed description of the invention is read in conjunction with the drawings wherein:

FIG. 1 is a fragmentary cross-sectional side view of a diaphragm pump as well known in the art, FIG. 2 is a plan view of the diaphragm of the present invention showing the relationship of the conductor member to the diaphragm, FIG. 6 is a plan view of an alternate failure indicating mechanism, FIG. 7 is a plan view of a further alternate failure indicating mechanism, FIG. 8 is a fragmentary perspective view of a diaphragm for use in the embodiment of FIG. 7, and FIG. 9 is a fragmentary view of the recess of FIG. 8.

DESCRIPTION OF THE INVENTION INCLUDING THE BEST MODE

Figure 3:
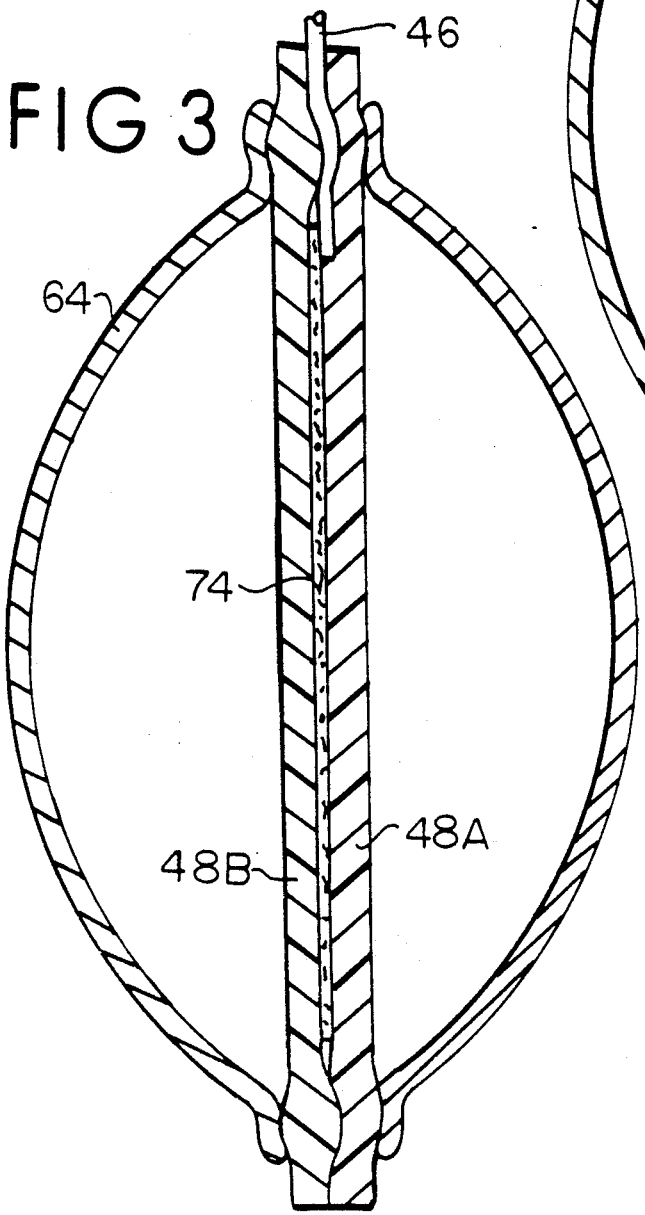
FIG. 3 is a fragmentary cross-sectional view of the failure sensing device shown in a pump housing.

The imminent failure of a diaphragm is predicted through the use of a failure sensing device, which in a preferred embodiment is constructed of a sorbant material which carries an electrically conductive member. A crack, fissure, tear or hole which appears in the diaphragm allows seepage of the fluid within the pump housing and is absorbed by the sorbant material, migrating or diffusing throughout the material until the electrically conductive material is exposed to the fluid. The electrically conductive material is connected by means of an electrical lead, to a source of an extremely low electrical voltage and the housing of the pump serves as the ground for the electrical circuit. The fluid within the pump completes the circuit, such that when the conductive material within the failure sensing device becomes exposed to the pump fluid, the circuit is completed and an alarm is sounded. Since the current and voltage levels are preferably maintained at a very low level, a transducer, as well known in the art, and the design of which does not constitute a part of the present invention, can be used to produce the necessary amplification to sound the alarm or activate a shut down mode.

FIG. 1 illustrates one type of prior art type of diaphragm pump and is not intended to be limiting, but rather the invention applies equally to any diaphragm pump which incorporates two side part diaphragms and which is being used with an electrically conductive liquid.

As illustrated in FIG. 1, the diaphragm pump 10 serves to pump the liquid 11 from the tank 12. The conduit 28 delivers liquid past the check valve 29 to the receiver. Due to the action on the diaphragm 25 by a fluid or a mechanical device, such as is well known in the art, the liquid 11 in the tank 12 is forced past the check valve 31 to the desired end point. The failure of the diaphragm 25 can result in inadequate pumping in the case of a mechanical failure of the membrane. In those instances, however, where the liquid being pumped chemically attacks the material of the diaphragm, the failure more typically takes the form of breaks in the diaphragm which eventually expands from the surface exposed to the liquid towards the other side of the diaphragm, thus delivering the liquid to of the pump which is not intended to be exposed to the chemically reactive liquid. The diaphragm material can be of a nitrile rubber, neoprene, Buna N, P.T.F.E., E.P.D.M., polyurethane and are available under trademarks such as DuPont's Viton, TEFLON and NORDEL.

The device of the instant invention functions by sensing any seepage through cracks, fissures, tears or holes in a diaphragm, at the initial stage, before the failure has progressed to point where any liquid can pass through the diaphragm.

As illustrated in FIG. 2 the failure sensing device 40 can include a sorbant material 44 which is of a shape and size to correspond to the shape and size of the diaphragms between which it is placed. The material 44 is of a flexible adsorbant or absorbant material, such as hydrophilic or wetable fabric, which will allow the liquid to spread across the material and make contact with the conductor element 42. The sorbant member itself need not be either electrically conductive or significantly chemically inert since it merely has to assure contact between the electrically conductive liquid and the conductive material 42 and does not have to stand up to long term exposure to the conductive liquid which is being pumped.

The electrically conductive element 42, can be stitched or otherwise affixed on the absorbent material so as to be reasonably distributed across the sections of the sorbant material 44. By way of illustration, this can be obtained by positioning the conductive element a predetermined amount radially inward from the outer edge of the sorbant material 44 and following the peripheral shape of the device 40 or forming a "X" in the middle of the material with the ends of the cross extending outwardly toward the edges of the material.

Particularly where the diaphragm is used with a central pump shaft, the sorbant material 44 and the diaphragm 48 can be annular members.

The foregoing described shapes or configurations of the electrically conductive element 42 are by why of example only and in no way are intended to restrict the instant intention in that the exact configuration is rendered no critical due to the use of the sorbant member 44. In certain instances, the electrical lead (or leads) 46 need only contact the sorbant material 44 and no additional conductive material need be employed.

The conductive material 42 can be a part of, or connected by means of a "pig-tail", that is, an electrical lead (or leads) 46, to a source of an extremely low electrical voltage with the housing of the pump serving as the ground for the electrical circuit. The conductor lead 46 can be shielded film electrical contact with the pump housing element 64 as required.

As illustrated in FIG. 3, the sorbant material 74 must be in electrically conductive contact with the electrical lead 46, and the circuit can be completed due to the fluid flow from the pump chamber to the sorbant material 74 and then to the electrically conductive lead 46. Obviously, the sorbant member 74 can be coated or impregnated with an electrically conductive material in order to enhance the system. For example, a metal, such as nickel, can be plated on the fabric to form a sensing grid.

Figure 4:
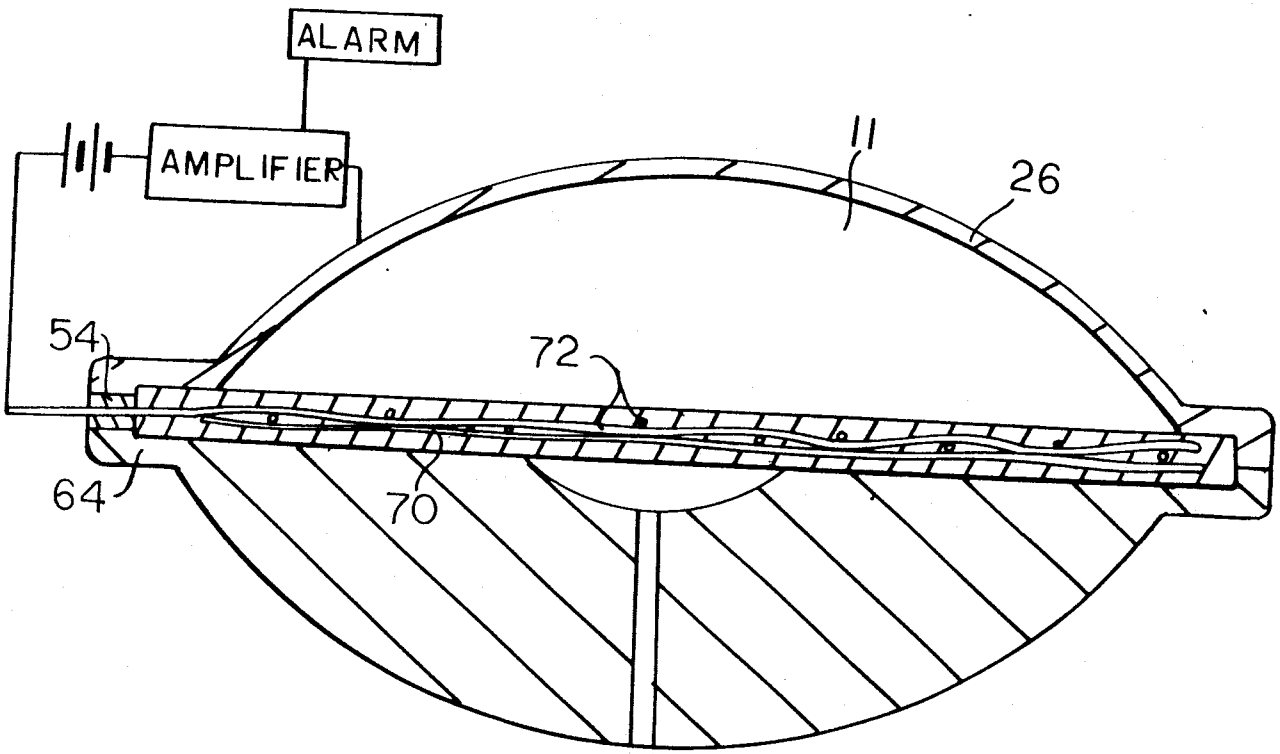
FIG. 4 is a fragmentary cross-sectional view of an alternate embodiment of the failure sensing device shown in a pump housing.

As illustrated in FIG. 4, electrically conductive liquid 11 is in electrically conductive contact with the diaphragm pump housing 26. .Thus the fluid 11, within the pump chamber 26 completes the circuit, such that when the sorbant material 70 and the conductive material 72, within the failure sensing device become exposed to the pump fluid 11 due to a diaphragm failure, the circuit is completed and an alarm is sounded or a system shut down is activated. The transducer produces the necessary amplification of the low level current and voltage and activates the alarm.

Figure 5:
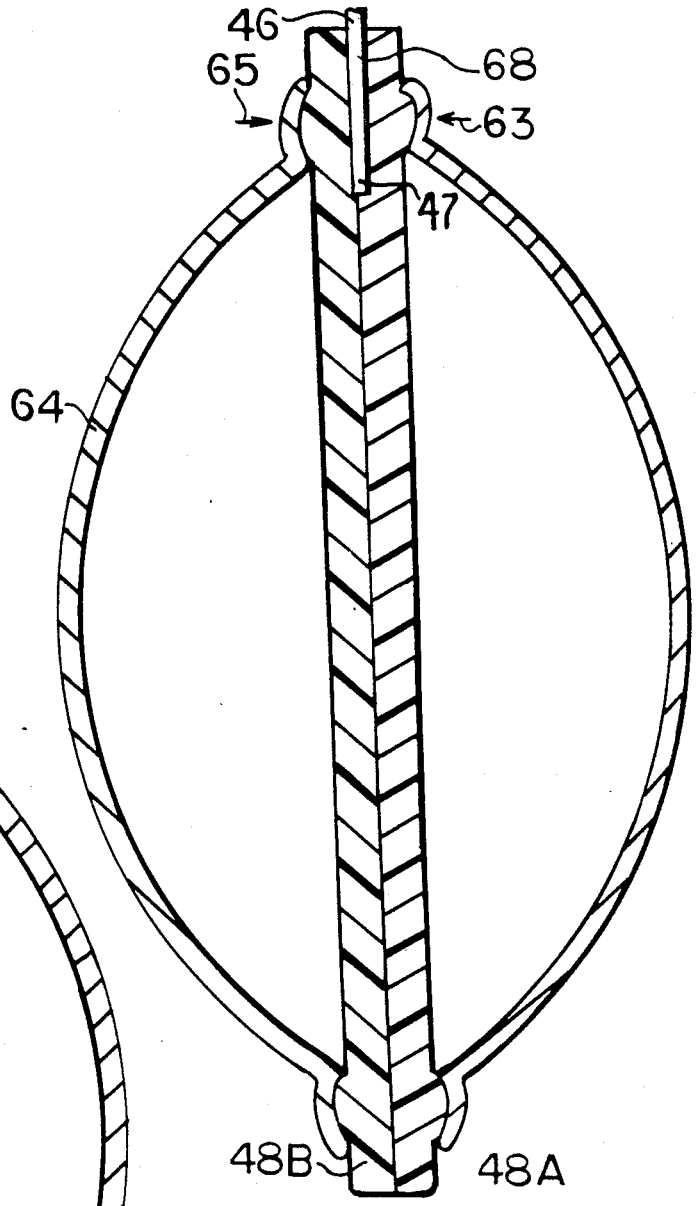
FIG. 5 is a fragmentary cross-sectional view of a further alternate embodiment of the failure sensing device shown in a pump housing.

In the embodiment of FIG. 5 electrical lead (or leads) 46 is positioned between the two diaphragm elements 48A and 48B, extending somewhat beyond the clamping region of the pump housing 64, indicated by the arrows 63 and 65 into the area in which the diaphragms 48 move. If a leak occurs in either of the diaphragms 48A or 48B, the close proximity and the movement of the diaphragms 48 will cause the liquid 11 to reach the probe 47, which is connected to the electrical lead 46, setting off the alarm. It is critical that the probe 47 of FIG. 5 be formed of graphite, or other substance having the same necessary qualifications. The probe 47 is subject to substantial movement at the flexure or pivot point 68 due to the flexing of the diaphragm while in use. The flexing stress at the pivot point 68 is great and any material subject to breakage from such movement cannot be used. If the probe 47 breaks at the pivot point 68 leaks can no longer be detected and the device is non-functional. In this embodiment no conductive material is employed and the tendency of the two diaphragm elements to separate is relied upon to provide a channel for migration of the liquid from the point of failure to the electrical lead 46.

A conductive material such as copper, would not provide the optimum results, as the flexing of the diaphragm tends to break the copper thereby severing part of the conductive material from the source of electrical power and could puncture the diaphragm. The alarm may not be triggered as rapidly if the diaphragm fails in a region in which the exposed copper is not connected to the powered system. Unlike previous devices, however, due to the spreading action of the conductive liquid through the material 44 the alarm will be triggered prior to any major damage since the conductive element need not be immediately proximate the point of failure. Thus, to obtain maximum accuracy and durability, it is preferred that the moisture spreading fabric of the failure sensing device be embedded with a fine filament or strand of a flexible conductive material. Preferably, a fine graphite filament is used since it has been found that the graphite filaments do not adversely affect the flexibility of the diaphragm. The exact dimensions of the graphite filament are not critical and commercially available materials can be readily employed in the instant invention. Obviously, although the thickness of the conductor screen is advantageously as small as can be practically attained, the dimensions must be such that the failure sensing device does not separate the diaphragms to a point which will break the seal between the two members. The failure sensing device utilizing the sorbant material 44 should substantially completely span the diaphragm radially, such as in a diaphragm which has an eleven inch radius, a ten inch radius for the failure sensing device produces the desired results. The conductive filaments, strands or the like must be clear of bolt holes or a center hole if required, so that there is no electrical connection. A clearance of at least ⅛ of an inch is required to provide a minimum safety factor so that there is no inadvertent electrical connection.

Once again, it should be clear that the fluid to be pumped must be sufficiently conductive to provide for a completed circuit when the embedded conductor becomes exposed to the fluid.

The instant invention would be particularly suited to diaphragm pumps which are handling a corrosive chemical, such as sulfuric acid, since diaphragms are highly sensitive to destruction by the acid. Additionally, leakage or migration of the acid can be destructive to components of the pump which are not intended to be exposed to the acid, as well as destructive to other hardware with which it can come in contact. Moreover, the acid is highly conductive and consequently works well to complete the electrical circuit.

A further modification of a failure indicating mechanism is illustrated in FIG. 6. In this embodiment the failure of a diaphragm is indicated visually by means of a high capillary action fabric 86 which functions like a wick. The high capillary wick member 86 is comparable to the sorbant member 74 of FIG. 3 and the sorbent material 44 of FIG. 2. Unlike the aforenoted modifications, however, the liquid flow must migrate past the clamping region 83 the outer end of the high capillary wick member. The effect of the clamping region 83 is, surprisingly, such that the flow is restricted but not prohibited. Thus, the indication of diaphragm failure is delayed relative to the moment in time in which liquid initially comes into contact with the high capillary wick member 86. However, this period of time, typically on the order of about five minutes, is extremely small relative to the time period for the imminent failure of the complete diaphragm.

Indication of the failure is signaled by means of migration of a dye across the outer region 88 of the high capillary wick member. The dye can be applied to the wick 86 by coating, impregnation or the like. The region of dye concentrate should not be located in the inner region 87 of the wick 86 and/or in the clamping region 83 in order to avoid contamination of the fluid being pumped. The dye which is soluble in the liquid being pumped, must be located just outside of the clamping region and becomes wetted by the liquid and flows across the outer region 88 of the wick 86. The dye can be concentrated in the form of a small band 85, of ink of the type commonly found in felt tip markers and can be in any desired color, such as red. It is the wicking action of the high capillary wick member which carries the dye across the entire exposed wick region to the outer edge 88 of the high capillary wick member 86.

The high capillary wick member 86 can take any desire shaped, as for example, an annular ring as illustrated in FIG. 2 or a member which more nearly fills the entire inner, that is, unclamped, region between the inner and outer diaphragm units. Preferably, the wick member 86 can be in the form of a rectangle whose dimensions are determined by the diameter of the diaphragms. The exposed region 87 of the high capillary wick member must, however, be sufficiently large to be readily visible. A wick member three inches by one half inch can provide at least a one inch by one-half inch exposed region and consequently would provide the desired results.

In a further modification, as illustrated in FIG. 7, the high capillary wick member 86 is connected to an electrically conductive lead 90 and a electrically conductive lead 92. These leads function in the manner of an electrical switch in that in those cases where the fluid being pumped is electrically conductive, a circuit is completed and an alarm device, as illustrated in FIG. 4, can be activated. Thus, the high capillary wick member 86 can either signal initial diaphragm failure by displaying a color or by completing an electrical circuit. The color change can be observed visually or can be electronically monitored as well known in the art, to activate an alarm device as in the case of the modification of FIG. 4.

In another modification as illustrated in FIG. 8, a groove or recess 94 can be provided in order to limit the compressive force on the high capillary wick member 86 at the clamping region 83. Total elimination of the compressive force can result in excessive fluid flow past the clamping region 83 either during pumping or after failure of one of the diaphragm units. Consequently, the recess should have a depth, as best seen in FIG. 8, which is less than the thickness of the high capillary wick member 86. For a high capillary wick member 86 having a thickness of one-eighth of an inch the recess should be at least about one thirty second of an inch less than the high capillary wick member 86 thickness. Similarly, the width of the recess 94, as best seen in FIG. 9, should be less than the width of the high capillary wick member 86.

What is claimed is:

1. In a diaphragm pump having a housing, a first chamber within said housing, a second chamber within said housing, a diaphragm mounted in said housing between said first chamber and said second chamber and a failure sensing device within said diaphragm, the improvement comprising:

said failure sensing device including a wetable material, said wetable material being completely enclosed in said diaphragm and being capable of transferring fluid being pumped by said diaphragm pump, through a break in said diaphragm, to an electrically conductive member, an electrically conductive member extending within said diaphragm and being in contact with said wetable material, said electrically conductive member extending radially inward, within said diaphragm, and includes conductor lead means, said conductor lead means extending through the peripheral edge of said diaphragm to a point exterior of said housing, said wetable material and said electrically conductive member being approximately equally spaced within said diaphragm, whereby, when failure occurs, conductive liquid contacts said electrically conductive member and completes a circuit to activate failure indicating means.

2. The device of claim 1, wherein said failure sensing device is formed from an absorbent, chemically inert, electrically non-conductive material and wherein said electrically conductive member is fixed thereto.

3. The device of claim 1, wherein said absorbent, chemically inert, electrically non-conductive material is soft and flexible with rapid liquid spreading capabilities.

4. The device of claim 1, wherein said electrically conductive member is stitched onto said wetable material.

5. The device of claim 1, wherein said wetable material is an annular member and said electrically conductive member conforms to the peripheral shape of said wetable material.

6. The device of claim 1, wherein said electrically conductive member is an electrically conductive graphite.

7. The device of claim 1, wherein said electrically conductive member is stitched to said wetable material along a circular path.

8. The device of claim 1, wherein said diaphragm is formed of two approximately equal halves.

9. The device of claim 1, wherein said wetable material is of a size and shape to correspond to the size and shape of said diaphragm.

10. The device of claim 1, wherein said diaphragm and said wetable material are annular in shape.

11. A failure sensing system for use in a diaphragm pump having a housing, a first chamber within said housing, a second chamber within said housing, a diaphragm mounted in said housing between said first chamber and said second chamber and a failure sensing device within said diaphragm, said failure sensing device comprising;

a wetable material, said wetable material being completely enclosed in said diaphragm and being capable of transferring fluid being pumped by said diaphragm pump, through a break in said diaphragm, to an electrically conductive member, an electrically conductive member extending within said diaphragm and being in contact with said wetable material, said electrically conductive member extending radially inward, within said diaphragm, and having conductor lead means, said conductor lead means extending through the peripheral edge of said diaphragm to a point exterior of said housing, said wetable material and said electrically conductive member being approximately equally spaced within said diaphragm, whereby, when failure occurs due to a break in said diaphragm, said conductive liquid contacts said electrically conductive member and completes a circuit to activate failure indicating means.

12. The device of claim 11, wherein said failure sensing device is formed from an absorbent, chemically inert, electrically non-conductive material and said electrically conductive member is fixed thereto.

13. The device of claim 11, wherein said absorbent, chemically inert, electrically non-conductive material is soft and flexible with rapid liquid spreading capabilities.

14. The device of claim 11, wherein said electrically conductive member is stitched onto said wetable material.

15. The device of claim 11, wherein said wetable material is an annular member and said electrically conductive member conforms to the peripheral shape of said wetable material.

16. The device of claim 11, wherein said electrically conductive member is an electrically conductive graphite.

17. The device of claim 11, wherein said electrically conductive member is stitched to said wetable material along a circular path.

18. The device of claim 11, wherein said diaphragm is formed of two approximately equal halves.

19. The device of claim 11, wherein said wetable material is of a size and shape to correspond to the size and shape of said diaphragm.

20. The device of claim 11, wherein said diaphragm and said wetable material are annular in shape.

* * * * *